US008555907B2

(12) United States Patent
Kutz

(10) Patent No.: US 8,555,907 B2
(45) Date of Patent: Oct. 15, 2013

(54) NON-SLIP TIP SYSTEM

(76) Inventor: Lawrence Jay Kutz, Hurley, WI (US)

( * ) Notice: Subject to any disclaimer, the term of this patent is extended or adjusted under 35 U.S.C. 154(b) by 0 days.

(21) Appl. No.: 13/354,032

(22) Filed: Jan. 19, 2012

(65) Prior Publication Data

US 2012/0186617 A1 Jul. 26, 2012

Related U.S. Application Data

(60) Provisional application No. 61/435,850, filed on Jan. 25, 2011.

(51) Int. Cl.
*A45B 9/04* (2006.01)
*A61H 3/02* (2006.01)

(52) U.S. Cl.
USPC ..... 135/77; 135/65; 135/80; 280/819; 280/823; 248/188.9; 248/530

(58) Field of Classification Search
USPC ..... 135/65–66, 70, 75, 6, 77–79, 80–819; 280/809, 811, 817, 819, 823–825; 248/188.8, 188.9, 295.11, 508, 510, 248/519, 526
See application file for complete search history.

(56) References Cited

U.S. PATENT DOCUMENTS

| | | | | | |
|---|---|---|---|---|---|
| 415,511 | A * | 11/1889 | Howgate | 135/81 |
| 619,235 | A * | 2/1899 | Schwarting | 135/80 |
| 862,455 | A * | 8/1907 | Dunkel | 135/70 |
| 970,497 | A * | 9/1910 | Harding | 135/70 |
| 1,305,867 | A * | 6/1919 | Atlas | 135/78 |
| 2,492,916 | A * | 12/1949 | Chute et al. | 135/80 |
| 2,501,890 | A * | 3/1950 | Desso, Sr. et al. | 135/70 |
| 3,646,949 | A * | 3/1972 | Streeter | 135/80 |
| 4,411,284 | A * | 10/1983 | Opitz | 135/81 |
| 4,964,430 | A * | 10/1990 | Janis | 135/78 |
| 5,377,710 | A * | 1/1995 | Laser | 135/66 |
| 7,503,337 | B1 * | 3/2009 | Morgan et al. | 135/70 |
| 2003/0075209 | A1 * | 4/2003 | Kyungil-Cho | 135/68 |

* cited by examiner

*Primary Examiner* — Winnie Yip
(74) *Attorney, Agent, or Firm* — Joseph T. Leone, Esq.; Daniel A. Blasiole; DeWitt, Ross & Stevens, S.C.

(57) ABSTRACT

A retractable, non-slip tip system for support devices such as canes and crutches is provided. The system includes a hollow body having openings on each of a proximal end and a distal end. The body is configured to slide over the shaft of a support device and affix to the support device in either an extended position, wherein the distal end of the body extends beyond a terminal end of the support device, or a retracted position, wherein the terminal end of the support device extends beyond the distal end of the body. Suitably placed apertures in each of the body and the support device facilitate the attachment of the body to the support device in the extended and retracted positions. When the body is in the extended position, gripping protrusions on the distal end of the body are exposed and provide extra traction for the support device on soft slippery surfaces.

20 Claims, 3 Drawing Sheets

NON-SLIP TIP SYSTEM

CROSS-REFERENCE TO RELATED APPLICATIONS

This application claims priority under 35 USC §119(e) to U.S. Provisional Patent Application 61/435,850 filed Jan. 25, 2011, the entirety of which is incorporated herein by reference.

FIELD OF THE INVENTION

The present invention is directed to non-slip tips, including retractable tips, for personal support devices such as canes and crutches.

BACKGROUND

Personal support devices such as canes, crutches, walkers, or other walking aids are helpful in enhancing the mobility of individuals in need thereof. However, the range of use of these devices is limited. These personal support devices typically include one or more shafts terminating in rubber tips that contact the ground. The rubber tips may work well for providing traction on hard, non-slippery surfaces but are prone to slipping on snowy, icy, muddy, or otherwise soft and slippery surfaces. There is a need for tips for personal support devices that are capable of providing greater traction when needed.

SUMMARY OF THE INVENTION

The present invention provides a non-slip tip system that addresses the aforementioned needs.

The non-slip tip system of the present invention includes a body. In one version of the invention, the body comprises a proximal end and a distal end and defines a cavity along a central longitudinal axis that opens to a proximal end-opening and a distal-end opening. The body also comprises a first portion at the proximal end and a second portion at the distal end. The cavity in the first portion comprises a first cross-sectional profile, and the cavity in the second portion comprises a second cross-sectional profile, wherein the second cross-sectional profile extends further from the central longitudinal axis than the first cross-sectional profile. The body further comprises gripping protrusions extending distally from the distal end. In addition, the body defines a plurality of apertures in the first portion.

The plurality of apertures preferably comprises opposed pairs of apertures. The plurality of apertures preferably comprises at least a first aperture disposed a first distance from the distal end and a second aperture disposed a second distance from the distal end. The body preferably defines a surface well in an outer surface of the first portion that surrounds one or more of the plurality of apertures.

The body of the present invention preferably includes detent tracks on its inner surface facing the cavity. The inner surface of the first portion preferably comprises at least a linear indentation that extends from a first aperture to a second aperture. The inner surface may alternatively or additionally comprise a linear indentation that extends from the proximal-end opening to one or more of the plurality of apertures.

The gripping protrusions are preferably peripherally arranged about the distal end of the body such that the distal-end opening defines a cross-sectional profile matching in size and shape the cross-sectional profile of the cavity in the second portion.

A support device comprising a shaft portion and a terminal end may be included with the body. The shaft portion is preferably configured to snugly and slidingly fit within the first portion of the body. The terminal end is preferably configured to be capable of being encompassed within the cavity of the second portion of the body. The shaft portion and the terminal end of the support device each preferably comprise a cross-sectional profile, wherein the cross-sectional profile of the terminal end extends from a central longitudinal axis of the shaft portion further than the cross-sectional profile of the shaft portion. The terminal end of the support device preferably comprises a removable tip.

The shaft portion preferably defines an aperture capable of being in register with at least one of the plurality of apertures in the body. The system is preferably configured such that the terminal end of the support device is encompassed within the second portion of the body when the aperture of the support device is in register with a first of the plurality of apertures of the body, and at least the terminal end of the support device extends distally beyond the gripping protrusions on the distal end of the body when the aperture of the support device is in register with a second of the plurality of apertures of the body. The system preferably further includes a fastener, such as a spring loaded detent stop, configured to fit through the at least one of the plurality of apertures in the body and the aperture in the shaft portion when the at least one of the plurality of apertures in the body and the aperture in the shaft portion are in register to reversibly affix the body to the support device. In other versions of the invention, the first portion of the body may define one or more apertures in the first portion, and the support device may define one or more apertures in the shaft portion capable of being in register with the one or more apertures in the first portion of the body. The system in this version is preferably configured such that the terminal end of the support device is encompassed within the second portion of the body when the one or more apertures of the support device is in register with the one or more apertures of the body in a first aperture alignment configuration, and at least the terminal end of the support device extends distally beyond the gripping protrusions on the distal end of the body when the one or more apertures of the support device is in register with the one or more apertures of the body in a second aperture alignment configuration.

The objects and advantages of the invention will appear more fully from the following detailed description of the preferred embodiment of the invention made in conjunction with the accompanying drawings.

Figure 1:
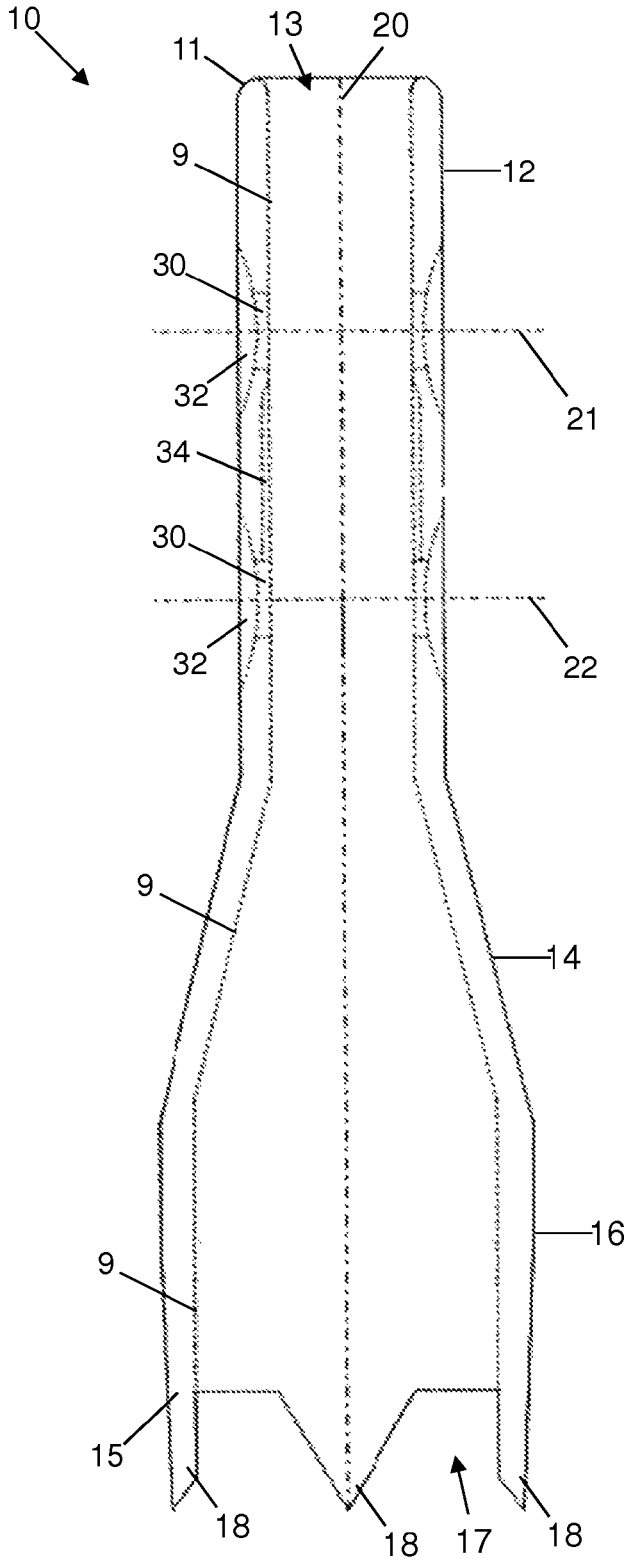
FIG. 1 depicts a side elevation view of a body of the non-slip tip system of the present invention.

Inner portions of the bodies shown in FIGS. 1-3B are depicted in phantom view.

DETAILED DESCRIPTION OF THE INVENTION

Exemplary components of the non-slip tip system of the present invention are depicted in FIGS. 1-3B, the reference numerals for which are used consistently throughout. One component of the non-slip tip system of the present invention is a body 10 having a proximal end 11 and a distal end 15. The body 10 is hollow, having an inner surface 9 that defines a cavity along and about a central longitudinal axis 20. The cavity opens to a distal-end opening 17 at the distal end 15 and a proximal-end opening 13 at the proximal end 11. The proximal-end opening 13 and distal-end opening 17 each define cross-sectional profiles configured to permit movement of portions of a support device therethrough. The cross-sectional profile of the proximal-end opening 13 is configured to permit movement of a shaft portion 40 of a support device therethrough. The distal-end opening 17 is configured to permit movement of a terminal end 44 of a support device therethrough. As used herein, "support device" refers to any of various devices that aid in opposing a force imposed by a person or object against a surface and have bar-like, surface-contacting portions. Examples include crutches, canes, and walkers that have ground-contacting, bar supports.

The exemplary bodies each include a narrow portion 12, a flared portion 14, and a bell portion 16 that define various different cross-sectional profiles of the cavity along the central longitudinal axis 20. The narrow portion 12 defines a cross-sectional profile of the cavity closely matching a cross-sectional profile defined by the shaft portion 40 of a support device so that the shaft portion 40 can snugly yet slidably fit within the cavity of the narrow portion 12. See, e.g., FIGS. 3A and 3B. The bell portion 16 defines a cross-sectional profile or range of cross-sectional profiles of the cavity configured to accommodate a terminal end 44 of a support device within the cavity of the bell portion 16. The flared portion 14 joins the inner surfaces of the narrow portion 12 and the bell portion 16 to define cross-sectional profiles that range from the cross-sectional profile of the narrow portion 12 to the cross-sectional profile of the bell portion 16.

The cavity defined by the body 10 in the exemplary versions defines a generally cylindrical shape with a circular cross-sectional profile that changes in size over its central longitudinal axis 20. The body 10, however, may define cavities having other cross-sectional profile shapes, including oval, square, rectangular, regular or irregular polygonal, etc., depending on the shape of the shaft portion 40 and terminal end 44 of the support device with which the body 10 is configured to be in accordance. The body 10 may also define a cavity that changes in cross-sectional profile shape over the central longitudinal axis 20. For example, a body 10 defining a cavity having a rectangular cross-sectional profile in the narrow portion 12 and a circular cross-sectional profile in the bell portion 16 may be used with support devices having a shaft portion 40 with a rectangular cross-sectional profile and a terminal end 44 with a circular cross-sectional profile, such as commonly occurs with conventional wooden crutches having rubber tips as terminal ends.

Figure 2A:
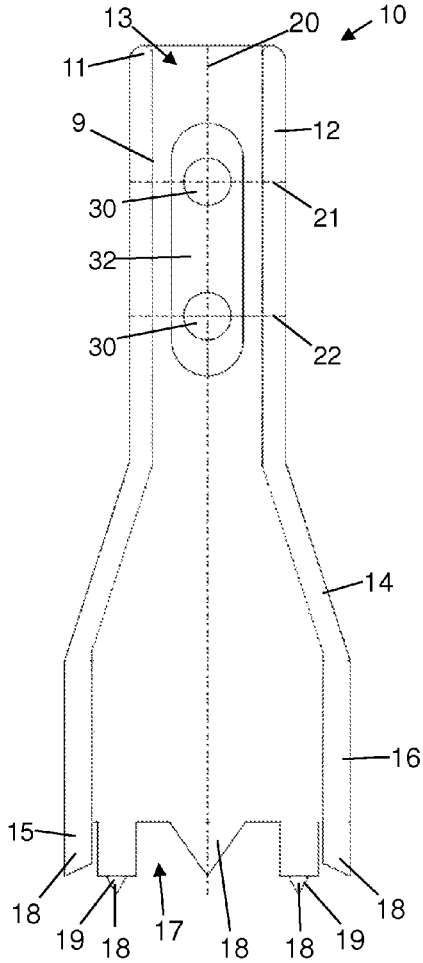
FIG. 2A depicts side elevation view of another version of a body of the non-slip tip system of the present invention.
Figure 2B:
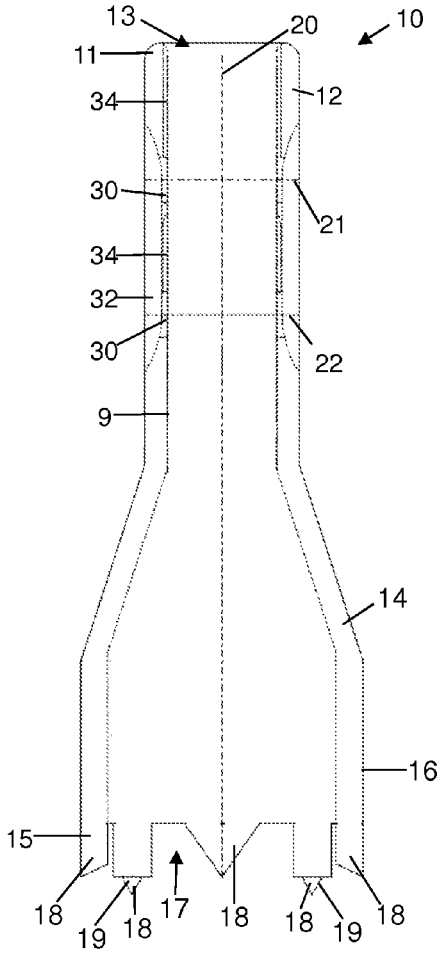
FIG. 2B depicts a side elevation view of the body of FIG. 2A rotated 90° about the central longitudinal axis.
Figure 2C:
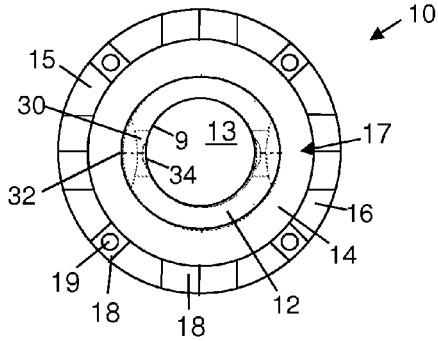
FIG. 2C depicts a bottom view of the body of FIG. 2B as viewed along the central longitudinal axis.

In preferred versions of the invention, the cross-sectional profile of the cavity defined by the bell portion 16 extends further from the central longitudinal axis 20 than the cross-sectional profile of the cavity defined by the narrow portion 12. This greater extension of the cross-sectional profile of the cavity defined by the bell portion 12 is to accommodate a terminal end 44 of conventional support devices within the bell portion 12, as the terminal end 44 of conventional support devices typically comprise removable rubber tips that have a cross-sectional profile that extends from a central longitudinal axis of the support device further than a cross-sectional profile of the shaft portion 40. An example of a cross-sectional profile of a cavity defined by a bell portion 16 that extends further from a central longitudinal axis than a cross-sectional profile of a cavity defined by a narrow portion 12 is shown in FIG. 2C (see FIG. 2B for position of the central longitudinal axis), wherein the cross-sectional profile of the bell portion 16 has a greater radius than the cross-sectional profile of the narrow portion 12. Depending on the particular shape and size of the terminal end 44 of the support device, the greater extension of the cross-sectional profile of the bell portion cavity may or may not be symmetric.

In the exemplary versions, an outer surface of the body 10 defines a cross-sectional profile that changes along the central longitudinal axis 20 in accordance with the cross-sectional profiles defined by the inner surface 9 at each of the narrow portion 12, the flared portion 14, and the bell portion 16. In this manner, the body 10 at each portion has a consistent thickness from the inner surface 9 to the outer surface. However, it is within the scope of the invention for the outer surface of the body 10 to define a consistent cross-sectional profile along the entire length of the central longitudinal axis 20 and for only the inner surface 9 of the body 10 to define differing cross-sectional profiles. profile along the entire length of the central longitudinal axis 20 and for only the inner surface of the body 10 to define differing cross-sectional profiles.

The body 10 comprises gripping protrusions 18 that extend distally from the distal end 15. The gripping protrusions 18 are shown as comprising sharp points, but they may be of any desired geometry. For example, if the intended use of the non-slip tip system is for outdoor use (perhaps on icy or wet surfaces) the gripping protrusions 18 may be quite sharp to facilitate a sure bite on those surfaces. If the device might be used principally indoors, a more blunt set of gripping protrusions 18 may be provided to afford suitable "bite," without ruining carpeting or other floor coverings. For additional traction on very slick surfaces, hardened points 19, such as steel studs and the like, may be affixed to the ends of one or more gripping protrusions 18.

The gripping protrusions 18 are arranged on the distal end 15 of the body 10 so that they do not occlude a terminal end 44 of the support device from moving through the distal-end opening 17. The gripping protrusions 18 are preferably peripherally arranged about the distal end 15 of the body 10 such that the distal-end opening 17 defines a cross-sectional profile matching the cross-sectional profile of the bell portion 16 in size and shape. As shown in FIG. 2C, the gripping protrusions 18 are circumferentially arranged and define a circular distal-end opening 17. Some bodies may comprise gripping protrusions 18 that extend from the body 10 in a non-parallel direction with respect to the central longitudinal axis 20, i.e., inwardly and/or outwardly with respect to the central longitudinal axis 20. Bodies that comprise gripping protrusions 18 that extend from the body 10 inwardly with respect to the central longitudinal axis 20 should be used with complementary-shaped terminal ends 44 to prevent occluding the terminal ends 44 from moving through the distal-end opening 17. For example, the terminal end 44 should have a peripheral notch corresponding to each inwardly directed gripping protrusion 18.

As shown in the exemplary versions, the body 10 preferably includes one or more apertures 30 that correspond with one or more apertures 41 in the support device. The apertures 30,41 are preferably oriented substantially orthogonally to the proximal-end opening 13. The apertures 30,41 are preferably provided in opposed pairs on opposite sides of the body 10 or shaft portion 40, respectively. The apertures 30,41 can be used to insert non-adhesive fasteners therethrough to affix the body 10 to the support device. Non-adhesive fasteners that can be used for this purpose include bolts, detent stops 42, and cotter pins such as split pins, hairpin cotter pins, and bowtie cotter pins. The non-adhesive fasteners can be used to reversibly attach the device to the support device. An adhesive may be used, either in addition to the non-adhesive fasteners or as an alternative to the non-adhesive fasteners, particularly if permanent or semi-permanent attachment is desired.

Figure 3A:
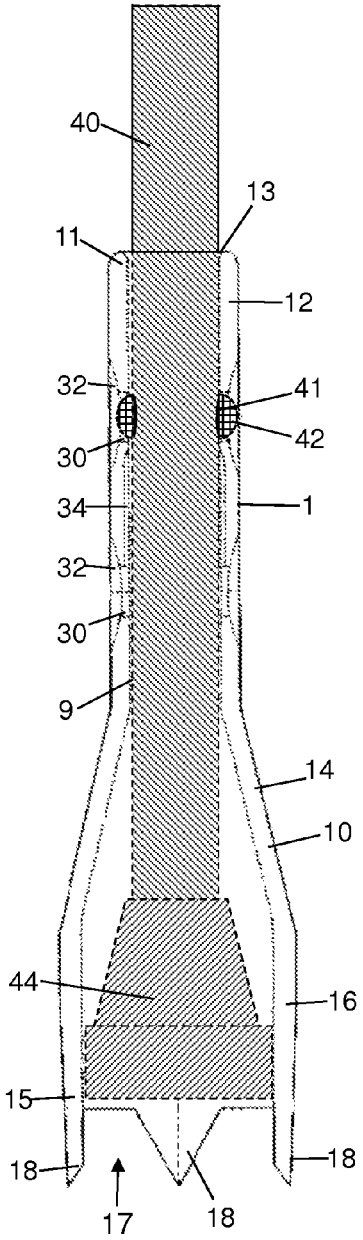
FIG. 3A depicts the body of FIG. 1 installed in an extended position on a shaft portion of a support device.
Figure 3B:
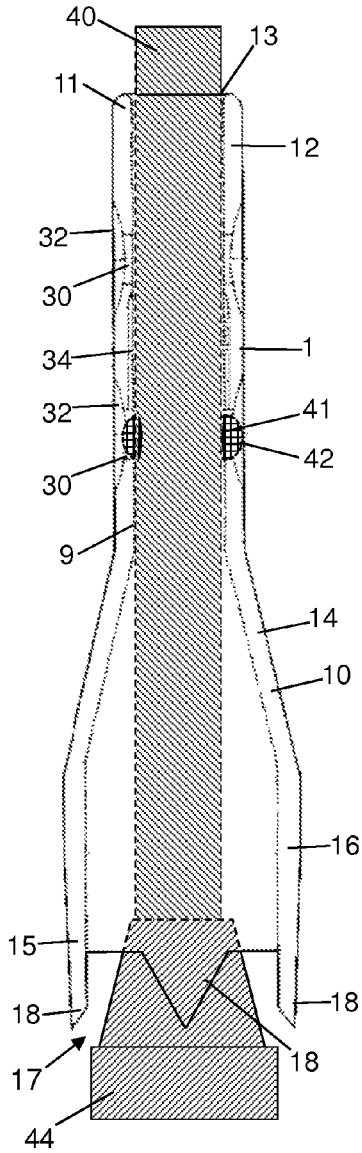
FIG. 3B depicts the body of FIG. 1 installed in a retracted position on the shaft portion of the support device.

In a preferred version of the invention, the non-slip tip system is a retractable non-slip tip system, wherein the body 10 is configured to slidably attach to a support device in both an extended position, as shown in FIG. 3A, and a retracted position, as shown in FIG. 3B. In the extended position, the terminal end 44 of the support device is entirely contained within the body 10, such as in the bell portion 16, such that at least the gripping protrusions 18 extend distally beyond the terminal end 44 of the support device. The extended position is useful when increased grip on soft or slippery surfaces is required. In the retracted position, the terminal end 44 of the support device extends distally beyond the distal end 15 of the body 10, such that a least a portion of the terminal end 44 extends beyond the gripping protrusions 18. The retracted position is useful when the increased grip afforded by the extended position is not required.

In one version of a retractable non-slip tip system of the present invention, the body 10 comprises two or more apertures 30 at different positions with respect to the distal end 15 that are capable of being in register with at least one aperture 41 in the shaft portion 40 of the support device. In another version, the shaft portion 40 of the support device comprises two or more apertures 41 at different positions with respect to the terminal end 44 that are capable of being in register with at least one aperture 30 in the body 10. In either version, the body 10 can be attached to the support device at various positions with respect thereto by aligning the apertures 30,41 in various aperture alignment configurations. To provide a largest number of possible positions, each of the body 10 and the shaft portion 40 can include multiple apertures 30,41 at different positions with respect to the distal end 15 and terminal end 44, respectively, such that a multitude of aperture alignment configurations are possible. The ability to obtain both extended and retracted positions is provided by suitable placement of the apertures 30,41 on each device.

The exemplary bodies shown in the drawings are both capable of providing a retractable non-slip tip system. Each body 10 includes two sets of opposed apertures 30. A first set is disposed in the body 10 at a proximal position 21 on the body 10 (see FIG. 1). A second set is disposed in the body 10 at a distal position 22 on the body 10 (see FIG. 1). The support device includes a single aperture 41 (if solid) or set of opposed apertures 41 (if hollow) capable of being in register with the apertures 30 at the various positions in the body 10 in at least two different aperture alignment configurations. When the apertures 30 at the proximal position 21 are aligned with the apertures 41 of the support device, as shown in FIG. 3A, the body 10 is in an extended position. When the apertures 30 at the distal position 22 are aligned with the apertures 41 of the support device, as shown in FIG. 3B, the body 10 is in a retracted position. A non-adhesive fastener is preferably used to stabilize the body in each respective position.

The exemplary non-adhesive fastener shown in FIGS. 3A and 3B includes a spring-loaded detent stop 42. The detent stop 42 reversibly locks the body 10 in either the extended or retracted position with respect to the support device by extending through both the apertures 41 in the support device and the corresponding apertures 30 in the body. The exemplary detent stop 42 is outwardly biased such that depressing it disengages it from the aperture 30 in the body 10. Once the detent stop 42 is disengaged from a particular aperture 30 in the body 10, the body 10 may be moved with respect to the support device either from an extended to a retracted position or from a retracted to an extended position. The detent stop 42 may then reengage in a different aperture 30 in the body 10 to lock the body 10 in position.

To aid in moving the detent stops 42 to and from various aperture 30,41 alignment configurations, the inner surface 9 of the body may include detent tracks 34, which are linear indentations that guide the outwardly biased detent stops 42 when moving toward different apertures 30. The version shown in FIGS. 1, 3A, and 3B includes detent tracks 34 between the apertures 30 at the proximal position 21 and the apertures 30 at the distal position 22. Such detent tracks 34 aid in adjusting the body 10 back and forth between the extended and retracted positions. The version shown in FIGS. 2A-2C further includes detent tracks 34 from the proximal-end opening 13 to the apertures 30 at the proximal position 21. Such detent tracks 34 aid in initially installing the body 10 on the support device, as described in further detail below.

To aid in depressing the detent stop 42 to disengage it from the aperture 30 in the body 10, the body 10 preferably includes a surface well 32 surrounding the aperture 30. The version of the body 10 shown in FIGS. 1, 3A, and 3B includes a separate surface well 32 for each aperture 30. The version of the body 10 shown in FIGS. 2A-2C includes a single surface well 32 for all the apertures 30 on a single side of the body 10.

In versions of the invention comprising multiple apertures 41 or sets of opposed apertures 41 in the support device but only a single aperture 30 or set of opposed apertures 30 in the body 10, an inwardly biased detent stop 42 is preferred. The inwardly biased detent stop 42 may be included, for example, on an elastic band that surrounds the body 10 and may project first through the apertures 30 in the body 10 and then through the apertures 41 in the support device. Detent tracks 34 to aid in the tracking of the inwardly biased detent stops 42 are included on the outer surfaces of the shaft portions 40 of the support devices in these versions.

The body 10 of the non-slip tip system of the present invention can be fabricated from any suitably stiff material such as metal, polymer plastics, wood, and the like. Metal and plastics are the preferred construction materials.

The body 10 of the non-slip tip system of the present invention can be installed on a support device by removing any removable tip provided as the terminal end 44 on the terminus of the shaft portion 40, sliding the narrow portion of the body 10 over the terminus of the shaft portion 40, fastening the body 10 to the shaft portion 40, and, if desired for use in a retracted position, re-attaching the removable tip on the shaft portion 40. When the shaft portion 40 is inserted within the cavity of the narrow portion, a central longitudinal axis of the support device is coaxial with the central longitudinal axis 20 of the body. The terminal end 44 of the support device is capable of moving through the bell portion 16 and distal-end opening 17 but not the narrow portion or the proximal-end opening 13. If the support device already has apertures 41 corresponding to apertures 30 in the body 10, non-adhesive fasteners can be used to fasten the body 10 to the support device. If the support device does not have apertures 41 corresponding to apertures 30 in the body 10, apertures 41 can be drilled into the support device at various suitable positions using the apertures 30 in the body 10 as a template. Non-adhesive fasteners can then be used to fasten the body 10 to the support device.

The elements and method steps described herein can be used in any combination whether explicitly described or not. All combinations of method steps as described herein can be performed in any order, unless otherwise specified or clearly implied to the contrary by the context in which the referenced combination is made. As used herein, the singular forms "a," "an," and "the" include plural referents unless the content clearly dictates otherwise. It is understood that the invention is not confined to the particular construction and arrangement of parts herein illustrated and described, but embraces such modified forms thereof as come within the scope of the claims.

I claim:

1. A non-slip tip system comprising a body, wherein the body:

comprises a proximal end and a distal end and defines a cavity along a central longitudinal axis that opens to a proximal end-opening and a distal-end opening;

comprises a first portion at the proximal end and a second portion at the distal end, wherein the cavity in the first portion comprises a first cross-sectional profile and the cavity in the second portion comprises a second cross-sectional profile, and wherein the second cross-sectional profile extends further from the central longitudinal axis than the first cross-sectional profile;

comprises gripping protrusions extending distally from the distal end; and defines a plurality of apertures in the first portion, wherein the plurality of apertures comprises a first aperture disposed a first distance from the distal end and a second aperture disposed a second distance from the distal end; and includes a detent track in an inner surface of the first portion of the body configured to guide an outwardly biased detent stop between the first and second apertures, wherein the detent track comprises a linear indentation in the inner surface extending between the first aperture and the second aperture, wherein the linear indentation comprises a width defined orthogonally with respect to the central longitudinal axis and tangentially with respect to the inner surface, wherein each of the plurality of apertures comprises a width defined orthogonally with respect to the central longitudinal axis and tangentially with respect to the inner surface, and wherein the width of the linear indentation is narrower than the width of each of the plurality of apertures.

2. The system of claim 1 wherein the plurality of apertures comprises opposed pairs of apertures.

3. The system of claim 1 wherein the gripping protrusions are peripherally arranged about the distal end of the body such that the distal-end opening defines a cross-sectional profile matching in size and shape the cross-sectional profile of the cavity in the second portion.

4. The system of claim 1 wherein the body defines a surface well in an outer surface of the first portion that surrounds one or more of the plurality of apertures.

5. The system of claim 1 further comprising a support device comprising a shaft portion and a terminal end, wherein the shaft portion is configured to snugly and slidingly fit within the first portion of the body and the terminal end is configured to be capable of being entirely encompassed within the cavity of the second portion of the body.

6. The system of claim 5 wherein the shaft portion and the terminal end of the support device each comprise a cross-sectional profile, wherein the cross-sectional profile of the terminal end extends from a central longitudinal axis of the shaft portion further than the cross-sectional profile of the shaft portion.

7. The system of claim 6 wherein the terminal end of the support device comprises a removable tip.

8. The system of claim 5 wherein the shaft portion defines an aperture capable of being in register with at least one of the plurality of apertures in the body.

9. The system of claim 8 configured such that the terminal end of the support device is encompassed within the second portion of the body when the aperture of the support device is in register with the first aperture, and at least the terminal end of the support device extends distally beyond gripping protrusions on the distal end of the body when the aperture of the support device is in register with the second aperture.

10. The system of claim 8 further comprising a fastener configured to fit through the at least one of the plurality of apertures in the body and the aperture in the shaft portion when the at least one of the plurality of apertures in the body and the aperture in the shaft portion are in register to reversibly affix the body to the support device.

11. The system of claim 10 wherein the fastener comprises a spring loaded detent stop.

12. The system of claim 1 wherein the detent track comprises opposed first and second ends wherein the linear indentation rises at the first end of the detent track to a level flush with the inner surface of the body at a first of the first and second apertures.

13. The system of claim 12 wherein the linear indentation extends at the second end of the detent track entirely to a second of the first and second apertures.

14. The system of claim 1 further comprising a second detent track in the inner surface of the first portion of the body, wherein the second detent track comprises a linear indentation in the inner surface extending from the proximal-end opening to at least one of the plurality of apertures.

15. A non-slip tip system comprising a body, wherein the body:

comprises a proximal end and a distal end and defines a cavity along a central longitudinal axis that opens to a proximal end-opening and a distal-end opening;

comprises a first portion at the proximal end and a second portion at the distal end, wherein the cavity in the first portion comprises a first cross-sectional profile and the cavity in the second portion comprises a second cross-sectional profile, and wherein the second cross-sectional profile extends further from the central longitudinal axis than the first cross-sectional profile;

comprises gripping protrusions extending distally from the distal end; and defines a plurality of apertures in the first portion, wherein an inner surface of the first portion comprises a linear indentation that extends from the proximal-end opening to at least one of the plurality of apertures.

16. A non-slip tip system comprising:

a body, wherein the body:

comprises a proximal end and a distal end and defines a cavity along a central longitudinal axis that opens to a proximal-end opening and a distal-end opening;

comprises a first portion at the proximal end and a second portion at the distal end, wherein the cavity in the first portion comprises a first cross-sectional profile and the cavity in the second portion comprises a second cross-sectional profile, and wherein the second cross-sectional profile extends further from the central longitudinal axis than the first cross-sectional profile;

comprises gripping protrusions extending distally from the distal end;

defines one or more apertures in the first portion; and includes a detent track in an inner surface of the first portion, wherein the detent track comprises a linear indentation in the inner surface extending to at least one of the one or more apertures in the first portion, wherein the linear indentation comprises a width defined orthogonally with respect to the central longitudinal axis and tangentially with respect to the inner surface, wherein each of the one or more apertures comprises a width defined orthogonally with respect to the central longitudinal axis and tangentially with respect to the inner surface, and wherein the width of the linear indentation is narrower than the width of each of the one or more apertures; and a support device, wherein the support device:

comprises a shaft portion and a terminal end, wherein the shaft portion is configured to snugly and slidingly fit within the first portion of the body and the terminal end is configured to be capable of being entirely encompassed within the cavity of the second portion of the body; and defines one or more apertures in the shaft portion capable of being in register with the one or more apertures in the first portion of the body;

wherein the terminal end of the support device is encompassed within the second portion of the body when the one or more apertures of the support device is in register with the one or more apertures of the body in a first aperture alignment configuration, and at least the terminal end of the support device extends distally beyond the gripping protrusions on the distal end of the body when the one or more apertures of the support device is in register with the one or more apertures of the body in a second aperture alignment configuration.

17. The system of claim 16 further comprising a spring-loaded detent stop configured to extend through the one or more apertures of the support device and the one or more apertures of the body when in register.

18. The system of claim 16 wherein the one or more apertures comprises a plurality of apertures comprising a first aperture disposed a first distance from the distal end and a second aperture disposed a second distance from the distal end, wherein the detent track comprises a linear indentation in the inner surface extending between the first aperture and the second aperture, wherein the detent track comprises opposed first and second ends wherein the linear indentation track rises at the first end of the detent track to a level flush with the inner surface of the body at a first of the first and second apertures and extends at the second end of the detent track entirely to a second of the first and second apertures.

19. The system of claim 18 further comprising a second detent track in the inner surface of the first portion of the body, wherein the second detent track comprises a linear indentation in the inner surface extending from the proximal-end opening to at least one of the plurality of apertures.

20. The system of claim 16 further comprising a second detent track in the inner surface of the first portion of the body, wherein the second detent track comprises a linear indentation in the inner surface extending from the proximal-end opening to at least one of the plurality of apertures.

* * * * *